US012193564B2

(12) United States Patent
Hwang

(10) Patent No.: US 12,193,564 B2
(45) Date of Patent: Jan. 14, 2025

(54) COSMETIC BRUSH

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 302 days.

(21) Appl. No.: 17/883,515

(22) Filed: Aug. 8, 2022

(65) Prior Publication Data

US 2023/0053468 A1 Feb. 23, 2023

(30) Foreign Application Priority Data

Aug. 19, 2021 (KR) ..... 10-2021-0109657

(51) Int. Cl.

| | |
|---|---|
| ***A46B 7/04*** | (2006.01) |
| ***A46B 5/00*** | (2006.01) |
| ***A46B 5/02*** | (2006.01) |
| ***A46B 9/00*** | (2006.01) |
| ***A46B 9/02*** | (2006.01) |

(52) U.S. Cl.

CPC ..... *A46B 5/0095* (2013.01); *A46B 5/02* (2013.01); *A46B 7/04* (2013.01); *A46B 9/021* (2013.01); *A46B 2200/1046* (2013.01)

(58) Field of Classification Search

CPC ..... A46B 7/046; A46B 9/021; A46B 3/00; A46B 11/00; A45D 34/04

See application file for complete search history.

(56) References Cited

U.S. PATENT DOCUMENTS

| | | | | |
|---|---|---|---|---|
| 3,434,176 | A * | 3/1969 | Cazet | A47L 13/255 15/177 |
| 5,054,946 | A * | 10/1991 | Morel | A45D 34/046 401/122 |
| 6,363,948 | B2 * | 4/2002 | Choi | A45D 33/34 132/320 |
| 8,230,543 | B2 * | 7/2012 | Shrier | A46B 7/04 15/176.1 |
| 9,125,483 | B1 * | 9/2015 | Diaz | A46B 7/04 |
| 10,799,015 | B1 * | 10/2020 | Velazquez | A46B 11/08 |
| 2009/0214285 | A1 * | 8/2009 | Cho | A45D 40/24 401/129 |

(Continued)

FOREIGN PATENT DOCUMENTS

| | | | |
|---|---|---|---|
| KR | 10-2007-0106025 | A | 10/2007 |
| KR | 10-2019-0121108 | A | 10/2019 |
| KR | 10-2020-0025383 | A | 3/2020 |

*Primary Examiner* — Michael D Jennings

(74) *Attorney, Agent, or Firm* — Heedong Chae; Lucem, PC

(57) ABSTRACT

A cosmetic brush includes: a brush grip provided as a grip for a user; a brush coupler coupled to the brush grip; a brush hair part coupled to the brush coupler and having hairs; and a connection fixer having a first side coupled to the brush grip and a second side supporting the hairs, and configured to surround the brush coupler, in which the brush grip includes a grip body provided as a grip for a user, and a connector unit having a first side coupled to the grip body and a second side to which the brush coupler is detachably coupled, the brush coupler includes a first coupler section and a second coupler section configured to be detachably coupled to each other, and the brush hair part is detachably coupled to the brush coupler.

11 Claims, 12 Drawing Sheets

(56) References Cited

U.S. PATENT DOCUMENTS

| | | | | |
|---|---|---|---|---|
| 2013/0014338 | A1* | 1/2013 | Park | A46B 5/0095<br>15/176.1 |
| 2014/0330289 | A1* | 11/2014 | Revivo | A46B 13/02<br>606/131 |
| 2015/0333609 | A1* | 11/2015 | Lattanzi | H02K 1/34<br>310/38 |
| 2016/0324306 | A1* | 11/2016 | Martin | A46B 9/021 |
| 2016/0331106 | A1* | 11/2016 | Khormaei | A47K 7/043 |
| 2017/0056685 | A1* | 3/2017 | Harvey | A61B 5/443 |
| 2017/0066023 | A1* | 3/2017 | Stolze | A46B 13/02 |
| 2018/0098615 | A1* | 4/2018 | George | A46B 5/0095 |
| 2018/0220783 | A1* | 8/2018 | Luu | A46B 5/0054 |
| 2020/0281341 | A1* | 9/2020 | Park | A45D 34/042 |
| 2020/0390221 | A1* | 12/2020 | Di Mella | A46B 5/0037 |
| 2022/0039539 | A1* | 2/2022 | Cattani | A45D 40/267 |

* cited by examiner

COSMETIC BRUSH

CROSS-REFERENCE TO RELATED APPLICATIONS

This application claims the priority of Korean Patent Application No. 10-2021-0109657 filed on Aug. 19, 2021, in the Korean Intellectual Property Office, the disclosure of which is incorporated herein by reference.

BACKGROUND OF THE INVENTION

Field of the Invention

The present disclosure relates to a cosmetic brush and, more particularly, to a cosmetic brush that can be assembled into a complete product without using an adhesive in the process of manufacturing the brush and of which components can be conveniently replaced.

Description of the Related Art

In general, cosmetics that are used for makeup are usually liquid, solid, and a mixture of liquid and solid. Brushes having various shapes or sizes have been developed and used to put solid-state cosmetics on the face.

That is, such brushes are configured to put a cosmetic made of a solid powder on the hairs thereof and appropriately apply the cosmetic on a face, etc. Such brushes are composed of a grip that a user can hold with a hand and a brush part made of a plurality of hairs and formed at the end of the grip.

In the related art, a brush part was attached to the grip using chemical substances such as an adhesive. In this case, there is a problem that since adhesives may have a harmful influence on human body because they are made of chemical substances, and the manufacturing cost increases when adhesives that are not harmful to human body are used.

Further, since adhesives are substances that are vulnerable to heat, there is a problem that when they are exposed to heat, the bonded portion is separated and durability decreases.

The above description is the background for helping understand the present disclosure and does not means the related art well known in the art.

DOCUMENTS OF RELATED ART

Patent Document

Korean Utility Model No. 20-0255125 (PARK Jang-Seong) 2001. 11. 12.

SUMMARY OF THE INVENTION

Accordingly, an objective of the present disclosure relates is to provide a cosmetic brush that can be assembled into a complete product without using an adhesive in the process of manufacturing the brush and of which components can be conveniently replaced.

According to an aspect of the present disclosure, there may be provided a cosmetic brush that includes: a brush grip provided as a grip for a user; a brush coupler coupled to the brush grip; a brush hair part coupled to the brush coupler and having hairs; and a connection fixer having a first side coupled to the brush grip and a second side supporting the hairs, and configured to surround the brush coupler, in which the brush grip includes a grip body provided as a grip for a user, and a connector unit having a first side coupled to the grip body and a second side to which the brush coupler is detachably coupled, the brush coupler includes a first coupler section and a second coupler section configured to be detachably coupled to each other, and the brush hair part is detachably coupled to the brush coupler.

The connector unit may be detachably coupled to the grip body.

The connector unit may include: a connector body detachably coupled to the grip body; a connector flange disposed on a side of the connector body and having a bottom supported on a top of the grip body; and a detachable body disposed on a side of the connector flange and having the brush coupler detachably coupled thereto.

The connector body may be detachably fitted in a first coupling groove formed at the grip body.

The detachable body and the brush coupler may be detachably thread-fastened to each other.

The grip body may further include a coupling body disposed on an upper end of the grip body, the connector unit may include: a first connector configured to surround a first side of the coupling body and coupled to the coupling body; and a second connector configured to surround a second side of the coupling body and coupled to the coupling body, and the brush coupler may be detachably coupled to outer walls of the first connector and the second connector.

A coupling hole may be formed in the coupling body, the first connector may further include a first coupling protrusion configured to be fitted in the coupling hole, and the second connector may further include a second coupling protrusion configured to be fitted in the coupling hole.

A first connector thread may be formed on an outer wall of the first connector, and a second connector thread may be formed on an outer wall of the second connector, whereby the brush coupler may be thread-fastened to the outer walls of the first connector and the second connector.

The first coupler may include: a first body configured to surround a first side of a lower portion of the brush hair part; a first inclined portion formed under the first body at an angle toward the brush grip; and a first coupling body formed under the first inclined portion and thread-fastened to the connector unit.

The second coupler may include: a second body configured to surround a second side of the lower portion of the brush hair part and detachably coupled to the first body; a second inclined portion formed under the second body at an angle toward the brush grip; and a second coupling body formed under the second inclined portion, thread-fastened to the connector unit, and detachably coupled to the first coupling body.

In embodiments of the present disclosure, a brush grip includes a connector unit to which a brush coupler is detachably coupled, the brush coupler is detachably coupled to the brush grip with the first coupler section and the second coupler section coupled to each other, and the brush hair part is detachably coupled to the brush coupler, so the cosmetic brush can be assembled without an adhesive, whereby it is possible to preclude the harmful constituents of adhesives.

Further, since a connection fixer is coupled to a brush grip and a brush coupler while covering the brush coupler, stability of coupling can be increased.

Further, since a brush hair part is detachably coupled to a brush coupler, it is possible to easily replace the brush hair part.

Further, since the upper end of a connection fixer can support the outer sides of a plurality of hairs, it is possible to prevent the hairs from spreading, etc.

Further, the shape of the brush hairs or coupling of the connection fixer (metal circular pipe) and the brush grip is free, so consumers can freely change brush grips or brush hairs having desired colors and the connection fixer made of metal, paper, plastic, etc., and can conveniently collect them after using them.

DETAILED DESCRIPTION OF THE INVENTION

Figure 1:
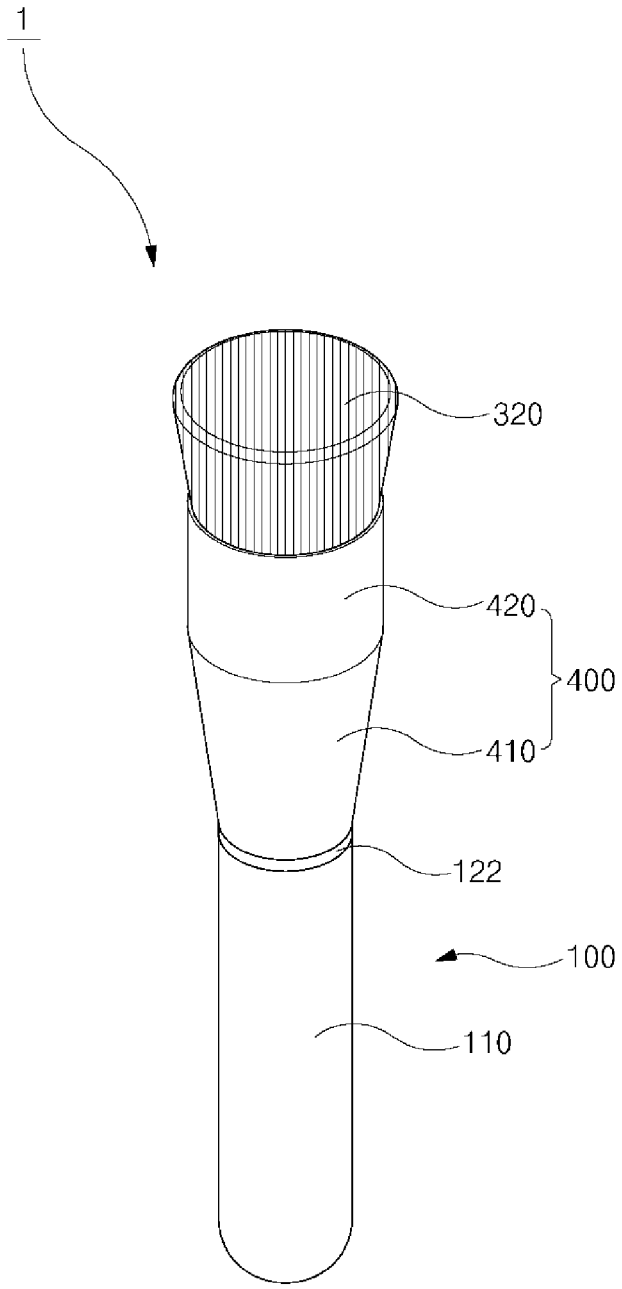
FIG. 1 is a view schematically showing cosmetic brush according to an embodiment of the present disclosure.

It is required to refer to the accompanying drawings exemplifying preferred embodiments of the present disclosure and the contents in the accompanying drawings to help sufficiently understand the present disclosure, the operational advantages of the present disclosure, and the objects that are achieved by implementing the present disclosure.

The present disclosure will be described hereafter in detail by describing exemplary embodiments of the present disclosure with reference to the accompanying drawings. Like reference numerals given in the drawings indicate like components.

Figure 2:
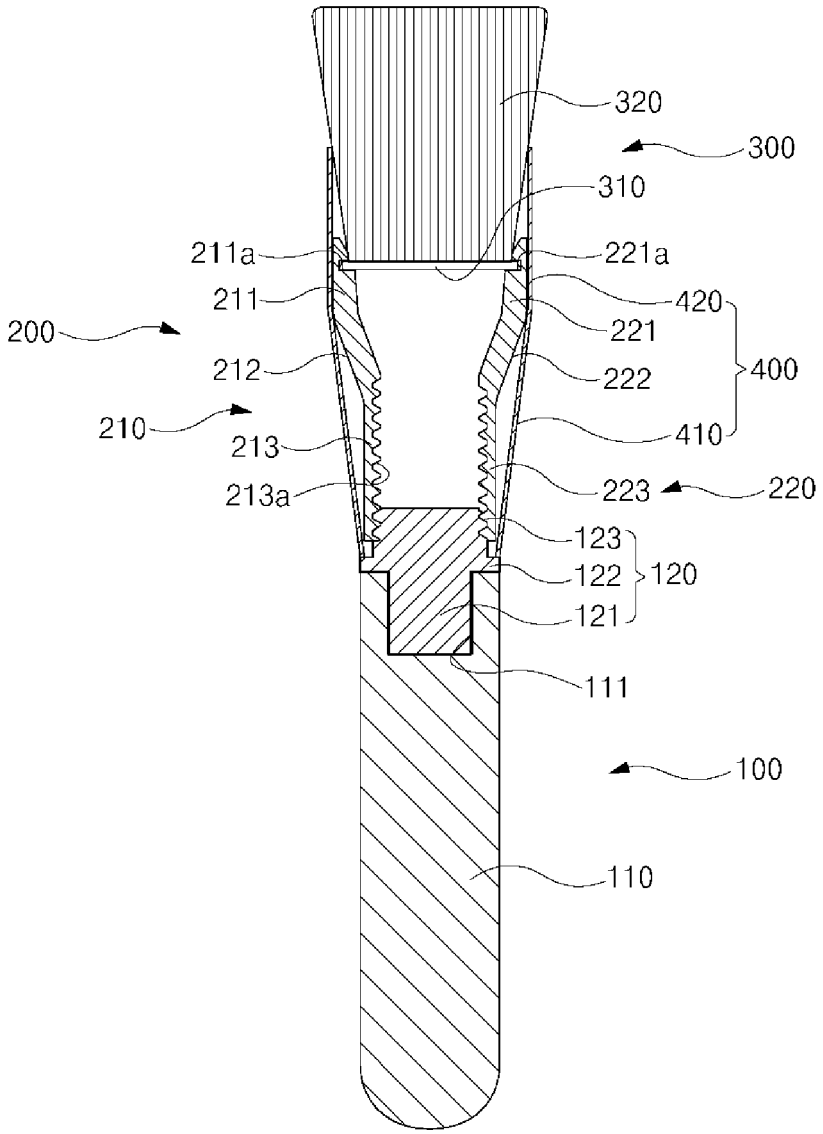
FIG. 2 is a cross-sectional view of FIG. 1.
Figure 3:
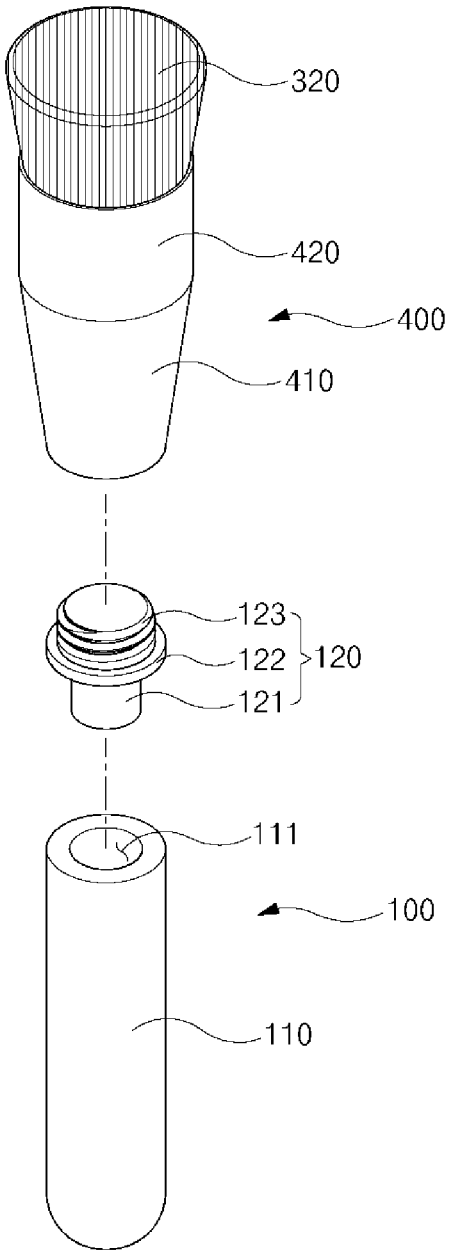
FIG. 3 is a schematic exploded perspective view of FIG. 1.
Figure 4:
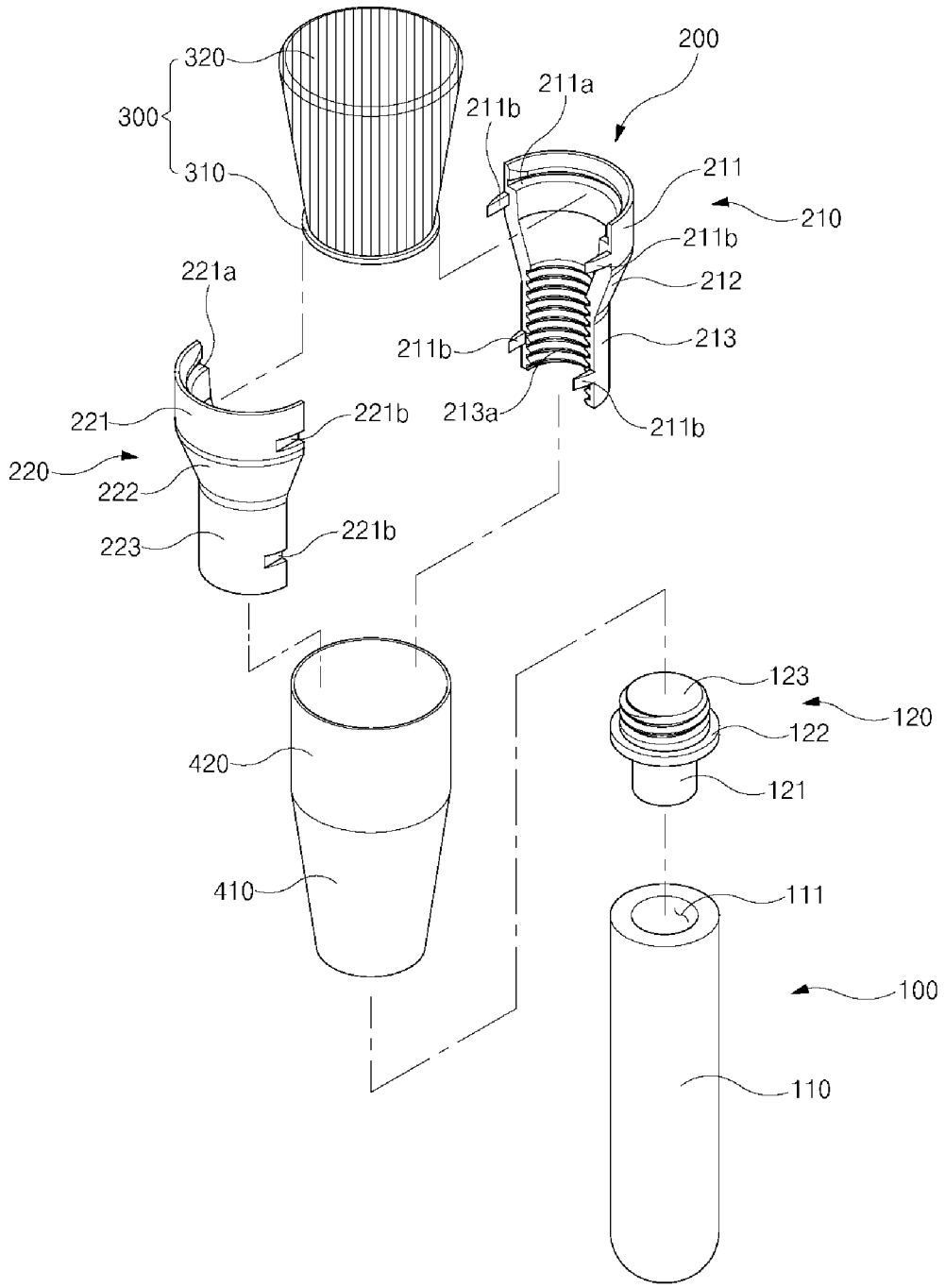
FIG. 4 is an entirely exploded perspective view of FIG. 3.
Figure 5:
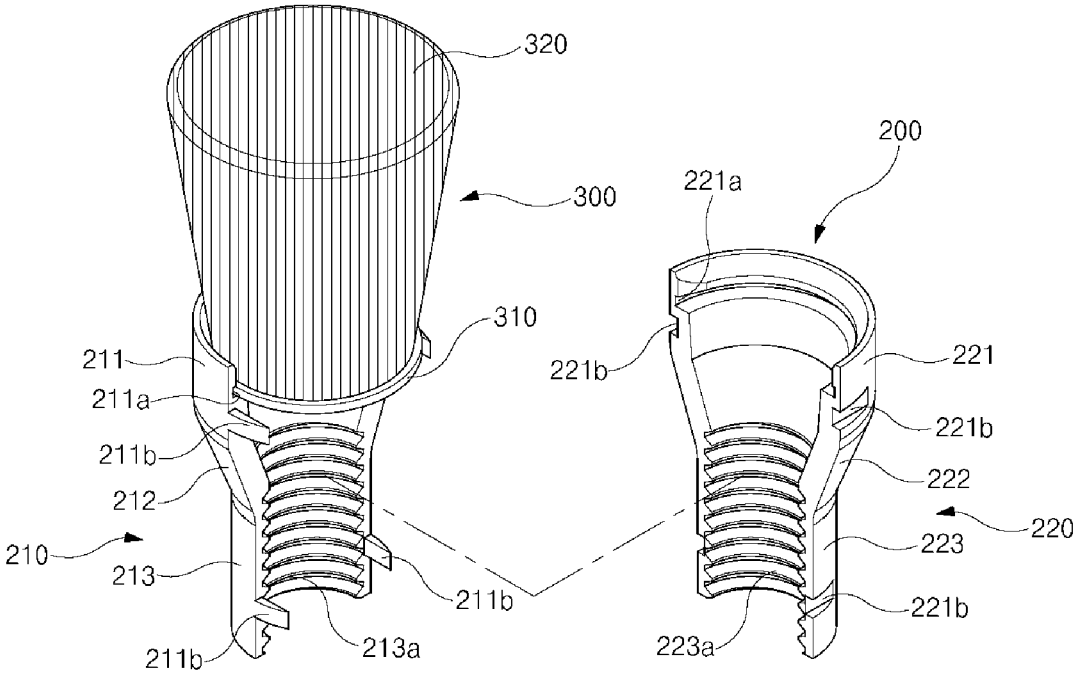
FIG. 5 is a view showing a brush coupler and a brush hair part shown in FIG. 4.
Figure 6:
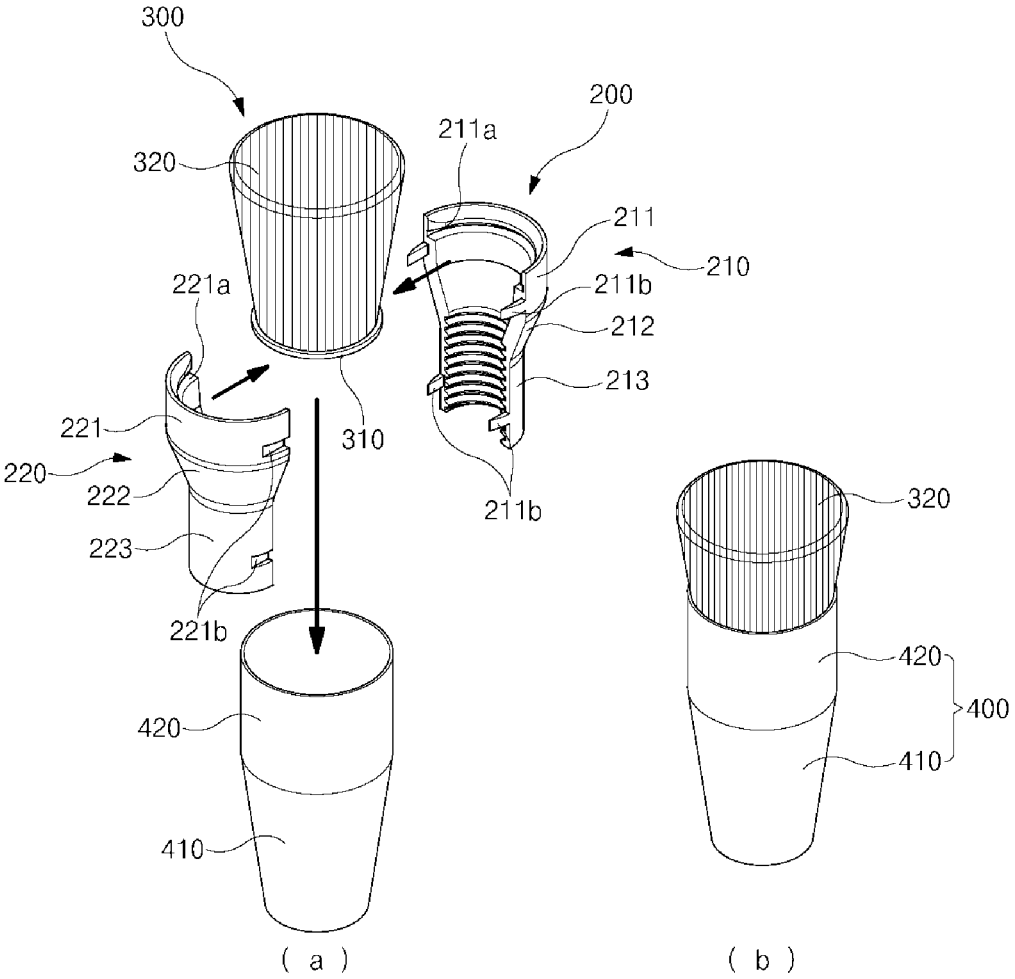
FIG. 6 is a coupling state view of the embodiment that shows a process of coupling the brush coupler, the brush hair part, and the connection fixer.
Figure 7:
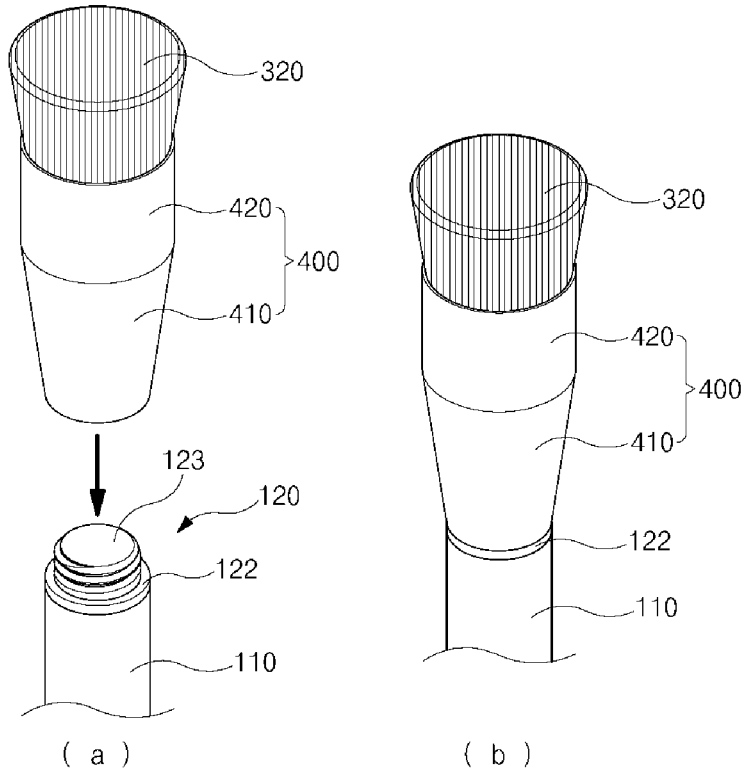
FIG. 7 is a coupling state view of the embodiment that shows a process of coupling the brush coupler coupled in FIG. 6 to a connector unit.

FIG. 1 is a view schematically showing cosmetic brush according to an embodiment of the present disclosure, FIG. 2 is a cross-sectional view of FIG. 1, FIG. 3 is a schematic exploded perspective view of FIG. 1, FIG. 4 is an entirely exploded perspective view of FIG. 3, FIG. 5 is a view showing a brush coupler and a brush hair part shown in FIG. 4, FIG. 6 is a coupling state view of the embodiment that shows a process of coupling the brush coupler, the brush hair part, and the connection fixer, and FIG. 7 is a coupling state view of the embodiment that shows a process of coupling the brush coupler coupled in FIG. 6 to a connector unit.

As shown in the figures, a cosmetic brush 1 according to the embodiment includes a brush grip 100 that is provided as a grip for a user, a brush coupler 200 that is coupled to the brush grip 100, a brush hair part 300 that detachably coupled to the brush coupler 200 and has hairs 320, and a connection fixer 400 of which a first side is coupled to the brush grip 100 and a second side supports the hairs 320 and that is configured to surround the brush coupler 200.

The brush grip 100, as shown in FIG. 2, may have a rod shape.

In the embodiment, the brush grip 100, as shown in FIG. 2, includes a grip body 110 that is provided as a grip for a user, and a connector unit 120 has a first side coupled to the grip body 110 and a second side to which the brush coupler 200 is detachably coupled.

As shown in FIG. 2, a first coupling groove 111 is formed in the grip body 110 of the brush grip 100, and a connector unit body 121 of the connector unit 120 may be detachably fitted in the first coupling groove 111.

The lower portion of the connector unit 120 of the brush grip 100 may be detachably fitted in the first coupling groove 111 formed in the grip body 110, and the upper portion thereof may be detachably thread-fastened to the lower portion of the brush coupler 200.

In the embodiment, the connector unit 120, as shown in FIGS. 2 and 3, includes a connector unit body 121 that is detachably coupled to the grip body 110, a connector unit flange 122 that is formed at the upper end of the connector unit body 121 and of which the bottom is supported on the top of the grip body 110, and a detachable body 123 that is formed on the top of the connector unit flange 122 and to which the brush coupler 200 is detachably thread-fastened.

The connector unit 120 may be made of a material including synthetic resin and this material may be applied in the same way to a connector unit 120*a* to be described below.

The brush coupler 200, which is provided as a part to which the brush hair part 300 is coupled, as shown in FIG. 2, may be detachably coupled to the upper end of the brush grip 100.

In the embodiment, the brush coupler 200, as shown in FIG. 4, includes a first coupler section 210 and a second coupler section 220 that are detachably coupled to each other, and the first coupler section 210 and the second coupler section 220 may be detachably coupled to the connector unit 120 of the brush grip 100 in the coupled state, as shown in FIG. 7.

The lower portions of the brush hairs 300 may be detachably inserted in the inner walls of the first coupler section 210 and the second coupler section 220.

The first coupler section 210 of the brush coupler 200, as shown in FIG. 5, includes a first body 211 that surrounds a first side of the lower portion of the brush hair part 300, a first inclined portion 212 that is formed under the first body 211 at an angle toward the brush grip 100, and a first coupling body 213 that is formed under the first inclined portion 212 and is thread-fastened to the brush grip 100.

The first body 211 of the first coupler section 210, as shown in FIG. 5, may have a first flange coupling groove 211*a*. In the embodiment, the first flange coupling groove 211*a* forms a circle together with a second flange coupling groove 221*a* of the second coupler section 220, whereby the flange member 310 of the brush hair part 300 can be detachably coupled. That is, in the embodiment, the flange member 310 can be detachably fitted in the circular coupling area formed by the first flange coupling groove 211*a* and the second flange coupling groove 221*a*.

In the embodiment, as shown in FIG. 5, the first body 211 has a pair of coupling protrusions 211*b* and the pair of coupling protrusions 211*b* can be inserted in protrusion coupling grooves 221*b* of the second coupler section 220.

In the embodiment, the pair of coupling protrusions 211*b*, as shown in FIG. 5, may be formed under the first flange coupling groove 211*a*. In the embodiment, the pair of coupling protrusions 211*b*, as shown in FIG. 5, may be formed at the first coupling body 213 as well.

The first inclined portion 212 of the first coupler section 210, as shown in FIG. 5, may have an upper end connected to the lower end of the first body 211 and a lower end connected to the upper end of the first coupling body 213. In the embodiment, the first inclined portion 212 may be formed such that the width gradually decreases toward the lower portion from the upper portion.

A first thread 213*a* may be formed on the inner wall of the first coupling body 213 of the first coupler section 210, as shown in FIG. 5, and a body thread 110 formed at the brush grip 100 can be detachably thread-fastened to the first thread 213*a*.

In the embodiment, since the first coupler section 210 and the second coupler section 220 are detachably coupled to each other, the brush hair part 300 can be easily separated for replacement from the brush coupler 200.

The second coupler section 220 of the brush coupler 200, as shown in FIG. 5, includes a second body 221 that surrounds a second side of the lower portion of the brush hair part 300 and is detachably coupled to the first body 211, a second inclined portion 222 that is formed under the second body 221 at an angle toward the brush grip 100, and a second coupling body 223 that is formed under the second inclined portion 222, is thread-fastened to the brush grip 100, and is detachably coupled to the first coupling body 213.

The second body 221 of the second coupler section 220, as shown in FIG. 5, may have a second flange coupling groove 221*a*. In the embodiment, the second flange coupling groove 221*a* forms a circle together with the first flange coupling groove 211*a* described above, whereby the flange member 310 of the brush hair part 300 can be detachably coupled.

In the embodiment, a pair of protrusion coupling grooves 221*b* is formed at the second body 221, as shown in FIG. 5, and the pair of coupling protrusions 211*b* described above can be inserted in the pair of protrusion coupling grooves 221*b*.

In the embodiment, the pair of protrusion coupling grooves 221*b*, as shown in FIG. 5, may be formed under the second flange coupling groove 221*a*. In the embodiment, the pair of protrusion coupling grooves 221*b* may be formed at the second coupling body 223 as well.

The second inclined portion 222 of the second coupler section 220, as shown in FIG. 4, may have an upper end connected to the lower end of the second body 221 and a lower end connected to the upper end of the second coupling body 223. In the embodiment, the second inclined portion 222 may be formed such that the width gradually decreases toward the lower portion from the upper portion.

A second thread 223*a* may be formed on the inner wall of the second coupling body 223 of the second coupler section 220, as shown in FIG. 4, and a body thread 110 formed at the brush grip 100 can be detachably thread-fastened to the second thread 223*a*.

The brush hair part 300, as shown in FIG. 4, can be detachably fitted in the first flange coupling groove 211*a* and the second flange coupling groove 221*a* formed at the brush coupler 200.

In the embodiment, the brush hair part 300, as shown in FIG. 2, includes a flange member 310, and a plurality of hairs 320 coupled to the top of the flange member 310.

The edge of the flange member 310 of the brush hair part 300, as shown in FIG. 2, can be inserted in the first flange coupling groove 211*a* and the second flange coupling groove 221*a*. In the embodiment, in order to replace the brush hair part 300, when a user separate the connection fixer 400 and them separate the first coupler section 210 and the second coupler section 220, the user can separate the flange member 310 from the first flange coupling groove 211*a* and the second flange coupling groove 221*a*, whereby it is possible to easily replace the brush hair part 300.

The lower ends of the hairs 320 of the brush hair part 300 may be coupled to the top of the flange member 310 by thermal bonding.

In the embodiment, the hairs 320 may be coupled to the flange member using an adhesive that is not harmful to a human body.

The connection fixer 400, as shown in FIG. 2, may be formed such that a first side is coupled to the brush grip 100 and a second side supports the hairs 320 and surrounds the brush coupler 200.

In the embodiment, the connection fixer 400, as shown in FIG. 2, includes a first fixing body 410 of which the lower end is supported on the brush grip 100, and a second fixing body 420 that extends upward from the first fixing body 410 and has an upper end supporting the hairs 320.

In the embodiment, the first fixing body 410 may be inclined toward the brush grip 100 from the lower end of the second fixing body 420.

In the embodiment, the first fixing body 410 may be formed such that the diameter is the largest at the upper end and gradually decreases toward the lower end.

In the embodiment, the lower end of the first fixing body 410 may be locked and supported by the upper portion of the brush grip 100.

In the embodiment, the connection fixer 400 may be made of materials including metal, paper, plastic, etc. Other well-known materials may be used.

Hereafter, an assembly sequence of the embodiment is described with reference to FIGS. 6 and 7.

First, as shown in FIG. 6(*a*), the lower portion of the brush hair part 300 is placed at the area corresponding to the upper portions of the first coupler section 210 and the second coupler section 220, and then the first coupler section 210 and the second coupler section 220 are coupled to each other, whereby the brush hair part 300 is coupled to the brush coupler 200.

Next, the lower portion of the brush coupler 200 assembled by coupling the first coupler section 210 and the second coupler section 220 is inserted downward into the connection fixer 400, as shown in FIG. 6(*b*).

Next, as shown in FIG. 7(*a*), the first fixing body 410 of the connection fixer 400 is detachably thread-fastened to the detachable body 123 of the connector unit 120, whereby the assembly process is finished, as shown in FIG. 7(*b*).

Figure 8:
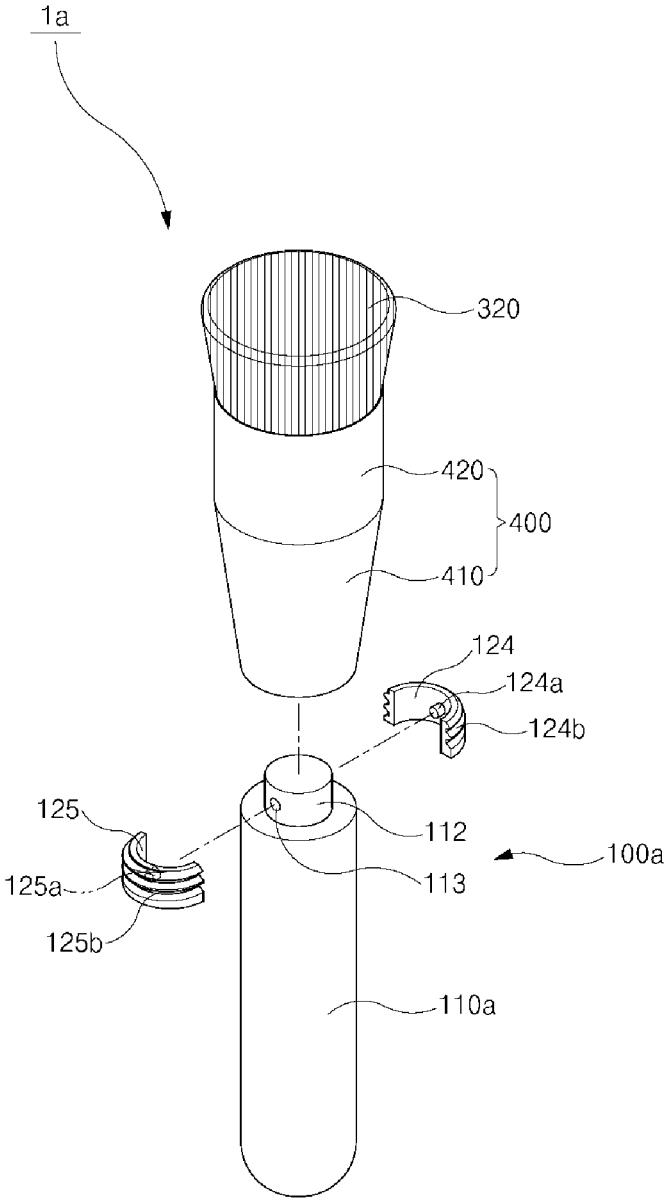
FIG. 8 is an exploded view schematically showing cosmetic brush according to another embodiment of the present disclosure.
Figure 9:
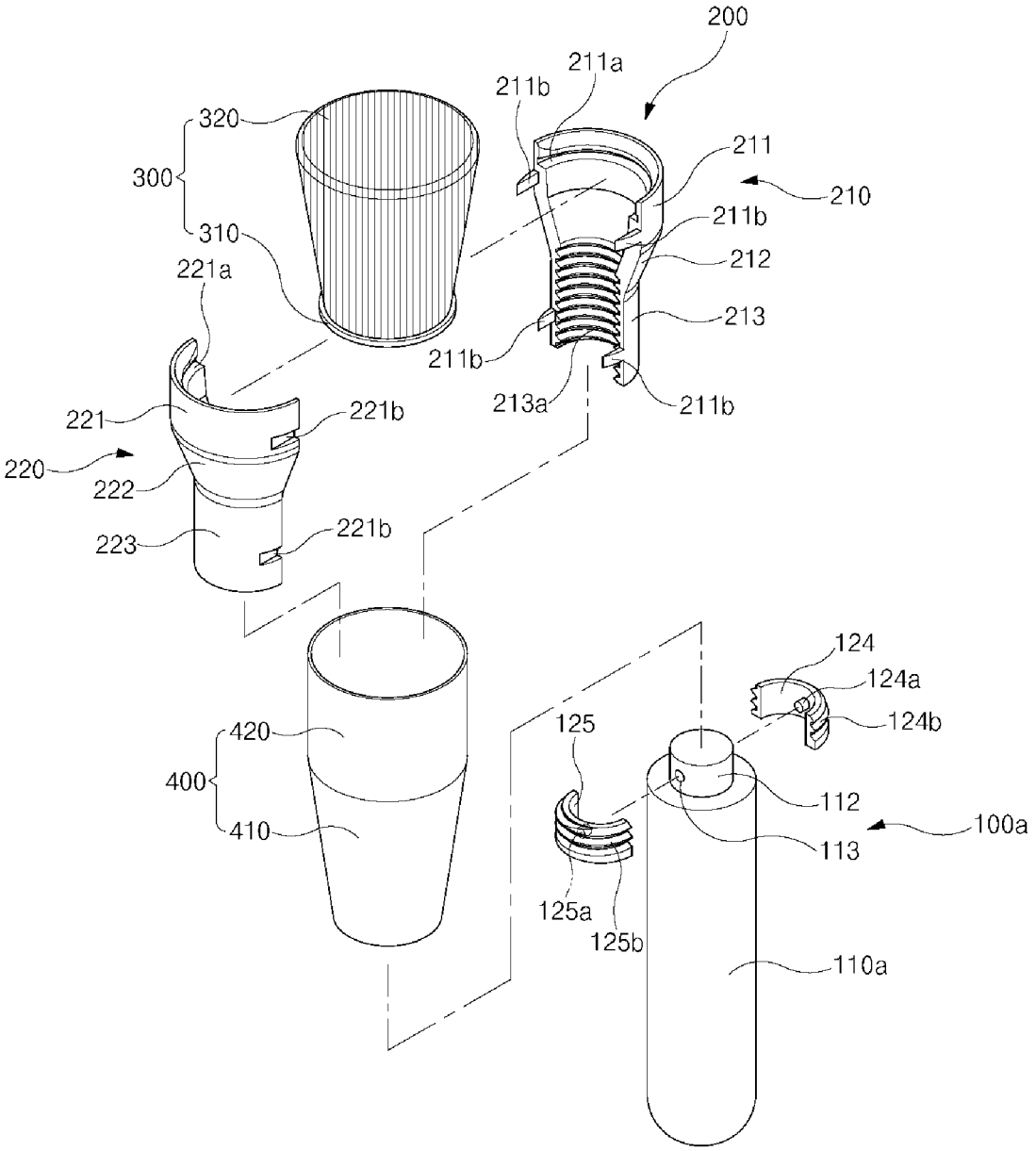
FIG. 9 is an entirely exploded perspective view of FIG. 8.
Figure 10:
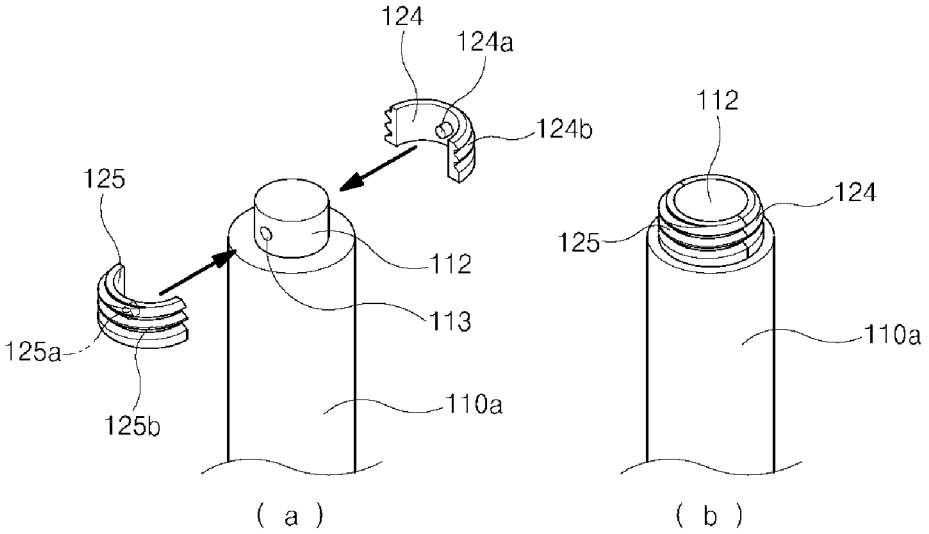
FIG. 10 is a view showing a process of coupling the connector unit shown in FIG. 8.
Figure 11:
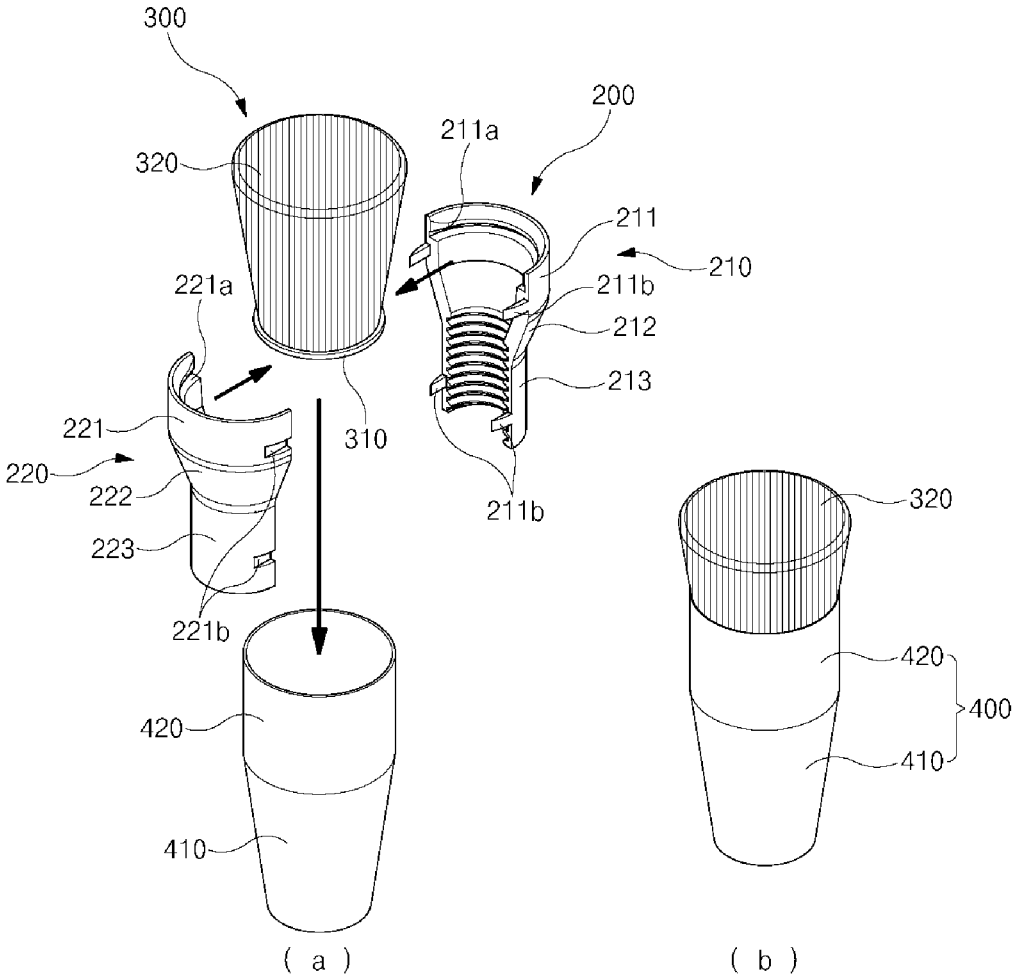
FIG. 11 is a coupling state view of the embodiment that shows a process of coupling the brush coupler, the brush hair part, and the connection fixer.
Figure 12:
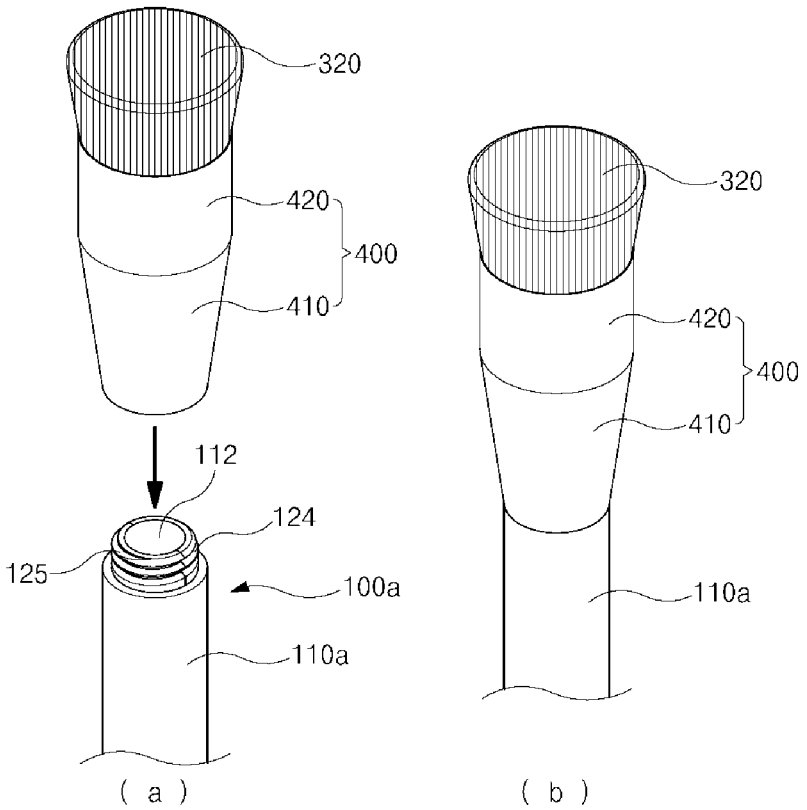
FIG. 12 is a coupling state view of the embodiment that shows a process of coupling the brush coupler coupled in FIG. 11 to a connector unit.

FIG. 8 is an exploded view schematically showing cosmetic brush according to another embodiment of the present disclosure, FIG. 9 is an entirely exploded perspective view of FIG. 8, FIG. 10 is a view showing a process of coupling the connector unit shown in FIG. 8, FIG. 11 is a coupling state view of the embodiment that shows a process of coupling the brush coupler, the brush hair part, and the connection fixer, and FIG. 12 is a coupling state view of the embodiment that shows a process of coupling the brush coupler coupled in FIG. 11 to a connector unit.

A cosmetic brush 1*a* according to this embodiment, as shown in FIG. 8, is different from the above embodiment in that a connector unit 120*a* of a brush grip 100*a* is separably provided and detachably coupled to the grip body 110.

Hereafter, only the differences from the above embodiment are described.

The grip body 110*a* of the brush grip 100*a*, as shown in FIGS. 8 and 10, includes a coupling body 112 disposed at the upper end of the grip body 110*a* and coupling holes 113 formed in the coupling body 112.

The connector unit 120*a* of the brush grip 100*a*, as shown in FIG. 10, includes a first connector 124 that is configured to surround a first side of the coupling body 112 and is coupled to the coupling body 112, and a second connector 125 that is configured to surround a second side of the coupling body 112 and is coupled to the coupling body 112.

In the embodiment, the brush coupler 200 may be detachably coupled to the outer walls of the first connector 124 and the second connector 125.

In the embodiment, the first connector 124 includes a first coupling protrusion 124*a* that is fitted in a coupling hole 113 and the second connector 125 includes a second coupling protrusion 125*a* fitted in a coupling hole 113 opposite to the coupling hole 113.

In the embodiment, a first connector thread 124*a* is formed on the outer wall of the first connector 124 and a second connector thread 124*b* is formed on the outer wall of the second connector 125, whereby the brush coupler 200 can be detachably thread-fastened to the outer walls of the first connector 124 and the second connector 125.

Hereafter, an assembly sequence of the embodiment is described with reference to FIGS. 11 and 12, etc.

First, as shown in FIG. 11(*a*), the lower portion of the brush hair part 300 is placed at the area corresponding to the upper portions of the first coupler section 210 and the second coupler section 220, and then the first coupler section 210 and the second coupler section 220 are coupled to each other, whereby the brush hair part 300 is coupled to the brush coupler 200.

Next, the lower portion of the brush coupler 200 assembled by coupling the first coupler section 210 and the second coupler section 220 is inserted downward into the connection fixer 400, as shown in FIG. 11(*b*).

Thereafter or before the above process, as shown in FIG. 10, the first connector 124 and the second connector 125 are fitted into the coupling holes 113 of the coupling body 112.

Next, as shown in FIG. 12(*a*), the first fixing body 410 of the connection fixer is detachably thread-fastened to the connector unit 120*a*, whereby the assembly process is finished, as shown in FIG. 12(*b*).

As described above, in an embodiment, a brush grip includes a connector unit to which a brush coupler is detachably coupled, the brush coupler is detachably coupled to the brush grip with the first coupler section and the second coupler section coupled to each other, and the brush hair part is detachably coupled to the brush coupler, so the cosmetic brush can be assembled without an adhesive, whereby it is possible to preclude the harmful constituents of adhesives. Further, since a connection fixer is coupled to a brush grip and a brush coupler while covering the brush coupler, stability of coupling can be increased. Further, since a brush hair part is detachably coupled to a brush coupler, it is possible to easily replace the brush hair part. Further, since the upper end of a connection fixer can support the outer sides of a plurality of hairs, it is possible to prevent the hairs from spreading, etc.

The present disclosure is not limited to the embodiment described above and it is apparent to those skilled in the art that the present disclosure may be changed and modified in various ways without departing from the spirit and scope of the present disclosure.

Accordingly, it should be noted that such changes and modifications are included in claims of the present disclosure.

What is claimed is:

1. A cosmetic brush comprising:

a brush grip provided as a grip for a user;

a brush coupler coupled to the brush grip;

a brush hair part coupled to the brush coupler and having hairs; and a connection fixer having a first side coupled to the brush grip and a second side supporting the hairs, and configured to surround the brush coupler, wherein the brush grip includes a grip body provided as a grip for a user, and a connector unit having first side coupled to the grip body and a second side to which the brush coupler is detachably coupled, the brush coupler includes a first coupler section and a second coupler section configured to be detachably coupled to each other, and the brush hair part is detachably coupled to the brush coupler, and wherein the connector unit includes:

a connector body detachably coupled to the grip body;

a connector flange disposed on a side of the connector body and having a bottom supported on a top of the grip body; and a detachable body disposed on a side of the connector flange and having the brush coupler detachably coupled thereto.

2. The cosmetic brush of claim 1, wherein the connector unit is detachably coupled to the grip body.

3. The cosmetic brush of claim 1, wherein the connector body is detachably fitted in a first coupling groove formed at the grip body.

4. The cosmetic brush of claim 1, wherein the detachable body and the brush coupler are detachably thread-fastened to each other.

5. The cosmetic brush of claim 1, wherein the first coupler includes:

a first body configured to surround a first side of a lower portion of the brush hair part;

a first inclined portion formed under the first body at an angle toward the brush grip; and a first coupling body formed under the first inclined portion and thread-fastened to the connector unit.

6. The cosmetic brush of claim 5, wherein the second coupler includes:

a second body configured to surround a second side of the lower portion of the brush hair part and detachably coupled to the first body;

a second inclined portion formed under the second body at an angle toward the brush grip; and a second coupling body formed under the second inclined portion, thread-fastened to the connector unit, and detachably coupled to the first coupling body.

7. A cosmetic brush comprising:

a brush grip provided as a grip for a user;

a brush coupler coupled to the brush grip;

a brush hair part coupled to the brush coupler and having hairs; and a connection fixer having a first side coupled to the brush grip and a second side supporting the hairs, and configured to surround the brush coupler, wherein the brush grip includes a grip body provided as a grip for a user, and a connector unit having a first side coupled to the grip body and a second side to which the brush coupler is detachably coupled, the brush coupler includes a first coupler section and a second coupler section configured to be detachably coupled to each other, and the brush hair part is detachably coupled to the brush coupler, wherein the grip body further includes a coupling body disposed on an upper end of the grip body, the connector unit includes:

a first connector configured to surround a first side of the coupling body and coupled to the coupling body; and a second connector configured to surround a second side of the coupling body and coupled to the coupling body, and the brush coupler is detachably coupled to outer walls of the first connector and the second connector.

8. The cosmetic brush of claim 7, wherein a coupling hole is formed in the coupling body, the first connector further includes a first coupling protrusion configured to be fitted in the coupling hole, and the second connector further includes a second coupling protrusion configured to be fitted in the coupling hole.

9. The cosmetic brush of claim 7, wherein a first connector thread is formed on an outer wall of the first connector, and a second connector thread is formed on an outer wall of the second connector, whereby the brush coupler is thread-fastened to the outer walls of the first connector and the second connector.

10. A cosmetic brush comprising:

a brush grip provided as a grip for a user;

a brush coupler coupled to the brush grip;

a brush hair part coupled to the brush coupler and having hairs; and a connection fixer having a first side coupled to the brush grip and a second side supporting the hairs, and configured to surround the brush coupler, wherein the brush grip includes a grip body provided as a grip for a user, and a connector unit having a first side coupled to the grip body and a second side to which the brush coupler is detachably coupled, the brush coupler includes a first coupler section and a second coupler section configured to be detachably coupled to each other, and the brush hair part is detachably coupled to the brush coupler, wherein the first coupler includes:

a first body configured to surround a first side of a lower portion of the brush hair part;

a first inclined portion formed under the first body at an angle toward the brush grip; and a first coupling body formed under the first inclined portion and thread-fastened to the connector unit.

11. The cosmetic brush of claim 10, wherein the second coupler includes:

a second body configured to surround a second side of the lower portion of the brush hair part and detachably coupled to the first body;

a second inclined portion formed under the second body at an angle toward the brush grip; and a second coupling body formed under the second inclined portion, thread-fastened to the connector unit, and detachably coupled to the first coupling body.

* * * * *